US007927133B2

(12) United States Patent
Bianchi

(10) Patent No.: US 7,927,133 B2
(45) Date of Patent: Apr. 19, 2011

(54) ELEMENT FOR COUPLING A LIGHTING APPLIANCE TO AN ELECTRIC RAIL

(75) Inventor: Nereo Bianchi, Braganze (IT)

(73) Assignee: Turn Lights S.r.l., Vicenza (IT)

( * ) Notice: Subject to any disclaimer, the term of this patent is extended or adjusted under 35 U.S.C. 154(b) by 0 days.

(21) Appl. No.: 12/635,209

(22) Filed: Dec. 10, 2009

(65) Prior Publication Data

US 2010/0151711 A1 Jun. 17, 2010

(30) Foreign Application Priority Data

Dec. 17, 2008 (IT) ..... VE2008A0093

(51) Int. Cl.
*H01R 13/60* (2006.01)

(52) U.S. Cl. ..... 439/532; 362/648

(58) Field of Classification Search ..... 439/532; 362/648–649, 391

See application file for complete search history.

(56) References Cited

U.S. PATENT DOCUMENTS

| | | | | |
|---|---|---|---|---|
| 3,391,377 | A | 7/1968 | Corl | |
| 4,729,742 | A * | 3/1988 | Onishi et al. | 439/208 |
| 5,672,003 | A | 9/1997 | Shemitz | |
| 6,033,097 | A | 3/2000 | Harwood | |
| 6,135,615 | A * | 10/2000 | Lee | 362/648 |
| 6,547,588 | B1 * | 4/2003 | Hsu et al. | 439/535 |
| 2006/0039168 | A1 | 2/2006 | Mier-Langner | |

FOREIGN PATENT DOCUMENTS

| | | |
|---|---|---|
| DE | 29917693 | 4/2000 |
| DE | 202004017616 | 2/2005 |

OTHER PUBLICATIONS

European Search Report of priority application IT VE2008A000093, Nov. 17, 2009.

* cited by examiner

*Primary Examiner* — Truc T Nguyen
(74) *Attorney, Agent, or Firm* — Themis Law

(57) ABSTRACT

An element for coupling a lighting appliance to an electrified rail includes two separate components, the first of which exclusively provides the electrical connection to the electrified rail, and the second of which is mechanically separate from the first component and is of essentially of box form. In one embodiment, the second component includes a U-shaped bracket configured to clamp to the electrified rail from the outside, to support the lighting appliance, and to house electrical components, each lateral flange of the clamping bracket having an inner surface that is partially shaped to be complementary to the outer surface of the rail. The second component further includes a U-shaped bracket configured to interlink with the clamping bracket and to confine the volume defined by the clamping bracket that is not taken by the rail.

7 Claims, 2 Drawing Sheets

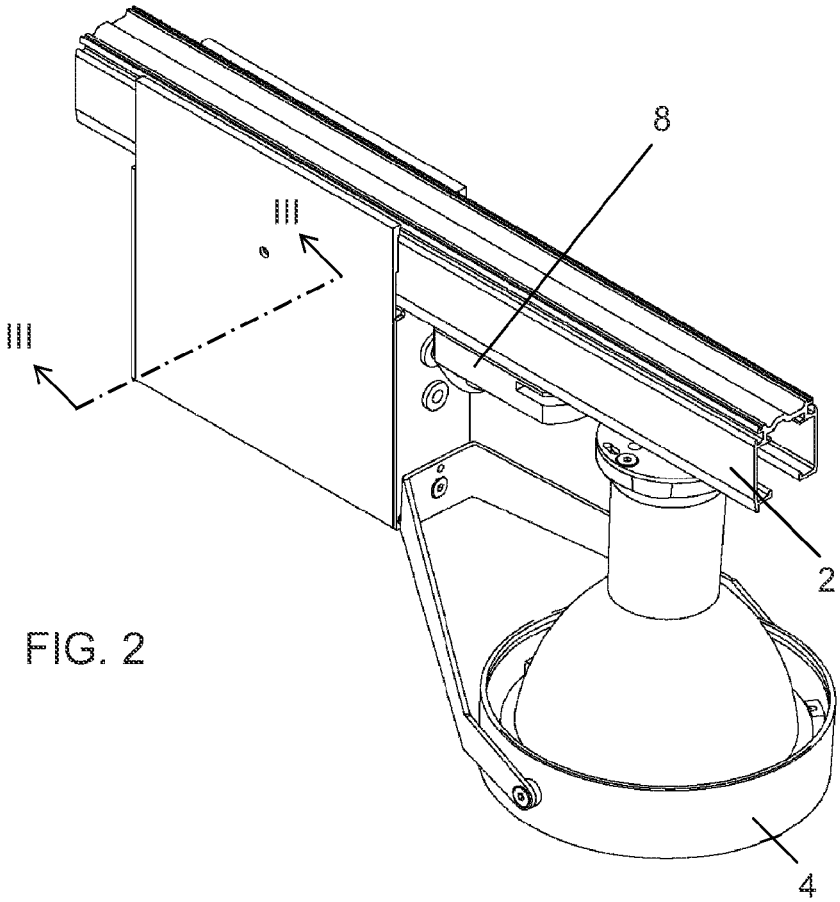
FIG. 2
FIG. 3
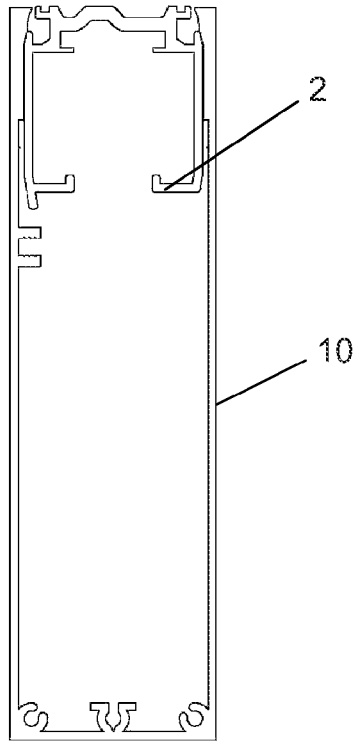
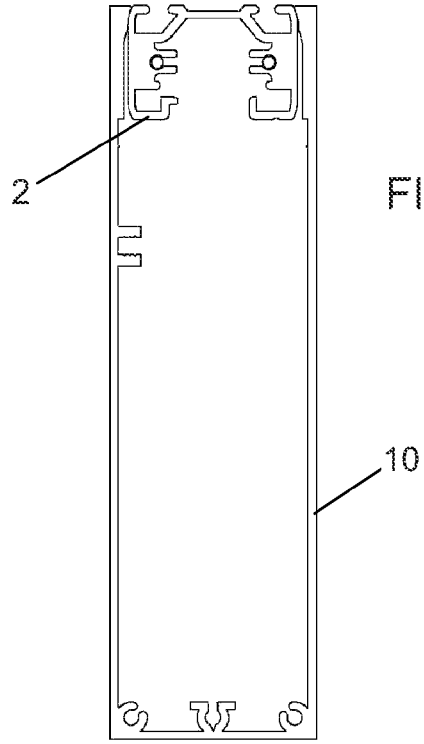
FIG. 4

ELEMENT FOR COUPLING A LIGHTING APPLIANCE TO AN ELECTRIC RAIL

FIELD OF THE INVENTION

The present invention relates to an element for coupling a lighting appliance to an electrified rail.

BACKGROUND OF THE INVENTION

Lighting systems are known that include electrified rails disposed in accordance to a variety of criteria within an environment to be lit, and a plurality of lighting appliances removably connected to the rails at predetermined points according to the desired results.

The lighting appliance is coupled to the rail with a suitable clamp, which provides both the mechanical connection and the electrical connection between the two. This is an undesirable feature, because the electrical appliance generally has a certain weight and subjects the clamp to mechanical stresses which inevitably cause deformations and which can result in unreliable electrical connections. In turn, an unreliable electrical connection causes a malfunction of the lighting appliance and can result in overheating and in the risk of fire.

U.S. Pat. No. 5,672,003 discloses to a system for coupling a lighting appliance to an electrified rail, which includes a first component providing the electrical connection with the electrified rail, and a second component, mechanically separate from the first component and essentially of box form, supporting the lighting appliance and housing electrical components.

SUMMARY OF THE INVENTION

An element for coupling a lighting appliance to an electrified rail according to the invention includes two separate components, the first of which is exclusively devoted to the electrical connection to the electrified rail, and the second of which is mechanically separate from the first one and is essentially of box form. The second component includes a U-shaped clamping bracket configured to clamp to the electrified rail from the outside, such to support the lighting appliance, and to house any electrical components. A portion of each lateral flange of the bracket provided for clamping to the rail has an inner surface shaped complementary to the outer surface of the rail. The second component further includes a U-shaped closure bracket, which interlinks with the clamping bracket and which confines that volume defined by the clamping bracket that is not taken by the rail.

BRIEF DESCRIPTION OF THE DRAWINGS

The present invention is further described with reference to the accompanying drawings, in which:

FIG. 2 is an assembled perspective view of the coupling element of FIG. 1;

FIG. 3 is a section therethrough along line III-III of FIG. 2; and

FIG. 4 is the same view as FIG. 3 but with the mechanical fixing element coupled to a different electrified rail.

DETAILED DESCRIPTION OF THE INVENTION

Figure 1:
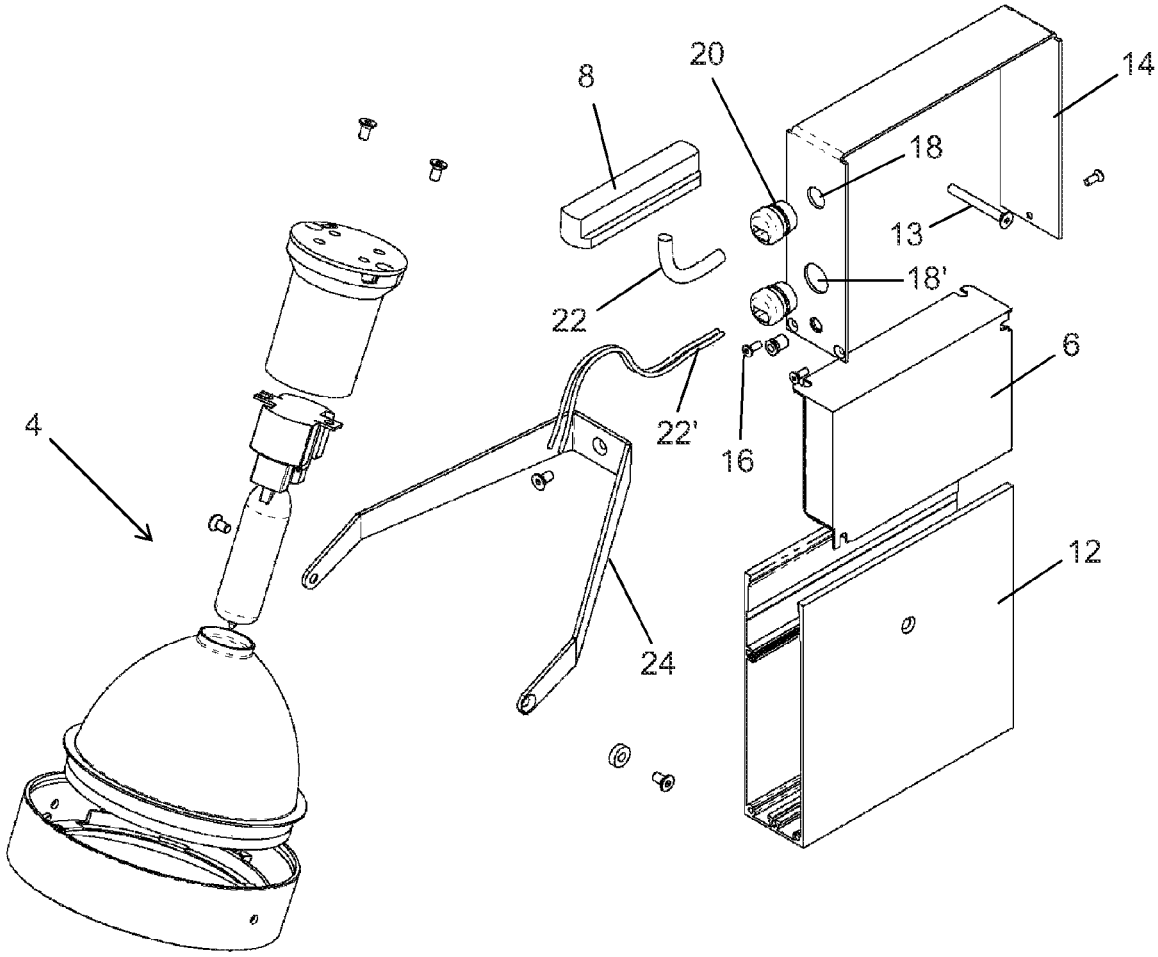
FIG. 1 is an exploded perspective view of the components of a coupling element according to the invention.

As it can be seen from the figures, a fixing element according to the invention consists essentially of two separate components, one of which, indicated by numeral 8, is intended for electrically connecting to electrified rail 2, and the other one of which, indicated by numeral 10, for supporting the lighting appliance 4, is intended for mechanically securing it to the rail 2, and for housing electrical equipment 6 (for example, a transformer, reactor, and/or general power supply unit), as required.

First component 8 consists essentially of a traditional electrical connector of a shape suitable for insertion into the longitudinal cavity of rail 2. First component 8 is provided with electrical contacts configured to mate with the bare electrical conductors provided on rail 2 when coupled with it.

Connector 8 can be secured to rail 2 by any type of connection, for example, insertion, bayonet or insertion with affixing by screws. These are traditional securing systems that require no further description, except to emphasize that connector 8 is not subjected to any mechanical stresses other those that deriving from its own weight, hence its dimensions need in practice to account for weight to ensure a proper electrical connection.

Second component 10 of the fixing element according to the invention includes a bracket 12 that is essentially U-shaped, with two lateral flanges configured to clamp to rail 2 from the outside for the mechanical connection thereto.

The overall height of clamping bracket 12 is essentially greater than the height of rail 2, that part of its lateral flanges configured for clamping having inner surfaces that are preferably shaped at least partially in a manner complementary to the outer lateral surfaces of the rail. By designing suitable shaping for the inner surfaces of the lateral flanges of clamping bracket 12, they can be adapted to electrified rails 2 of different types, as shown in FIGS. 3 and 4.

In their mounted condition, the two lateral flanges of bracket 12 are tightly clamped against the side walls of rail 2 by a screw 13.

The internal volume of bracket 12 that is not taken by rail 2, when clamping bracket 12 is clamped to it, is closed by a second bracket 14, interlinked with clamping bracket 12. The connection between closure bracket 14 and clamping bracket 12 can be advantageously made with screws 16 passing through corresponding holes provided in the two lateral flanges of closure bracket 14 and engaging longitudinal slots provided in the interior of clamping bracket 12. The internal volume closed by the two interlinked brackets 12, 14 can advantageously house electrical equipment 6 which may be required for operating lighting appliance 4, for example a reactor, a transformer and, more generally, a power supply unit.

To connect the input of a power unit 6 to the main supply drawn by connector 8, and to convey its output to lighting appliance 4, two openings 18, 18' are provided in the lateral flange of closure bracket 14 near lighting appliance 4, in order to enable for the passage of two electric cables 22, 22' via suitable cable protectors 20.

A support member 24 for lighting appliance 4 is affixed to that flange of closure bracket 14 that contains openings 18, 18' for passage of cables 22, 22'. Given the shape of the illustrated lighting appliance, support member 24 advantageously has the shape of a fork, although a person skilled in the art will appreciate that for different appliances different shapes suitable for such appliances may be selected.

From the foregoing description it can be seen that a coupling element according to the invention is particularly advantageous, because the two components provided for the electrical and mechanical connections are separated and independent of each other, eliminating mutual influences and, in particular, preventing inevitable mechanical stresses that may compromise the reliability of the electrical connection.

Moreover, the particular coupling of bracket 12 to rail 2 achieved by clamping from the outside makes an element according to the invention adaptable to electrified rails of different shapes within wide limits.

By splitting the mechanical and electrical connections into two the components, very simple and economical electrical connectors can be used, because such electrical connectors are not burdened with the mechanical connection.

Finally, a coupling element according to the invention completely hides accessory electrical equipment from view because of the box form of the mechanical connection member and of the facility for housing accessory electrical equipment therein.

While the invention has been described in connection with the above described embodiment, it is not intended to limit the scope of the invention to the particular forms set forth, but on the contrary, it is intended to cover such alternatives, modifications, and equivalents as may be included within the scope of the invention.

What is claimed is:

1. An element for coupling a lighting appliance to an electrified rail comprising:

a first component configured to provide only an electrical connection to the electrified rail; and a second components, mechanically separate from the first component and of essentially box form, comprising, a U-shaped clamping bracket configured to clamp to the electrified rail from outside of the electrified rail, to support the lighting appliance, and to house one or more electrical components, the clamping bracket comprising lateral flanges each having an inner surface, at least a portion of which is shaped complementary to an outer surface of the rail, and a U-shaped closure bracket configured to interlink with the clamping bracket to confine a volume, which is defined by the clamping bracket and which is not occupied by the electrified rail.

2. The element of claim 1, wherein the inner surfaces of the lateral flanges of the clamping bracket are at least partially shaped to conform to outer surfaces of different electrified rails.

3. The element of claim 1, wherein each of the inner surfaces of the lateral flanges of the clamping bracket includes two distinct zones configured to couple with lateral areas of two different electrified rails.

4. The element of claim 1, further comprising one or more fasteners for engaging at least one of the lateral flanges of the clamping bracket such to affix the at least one of the lateral flanges to the electrified rail.

5. The element of claim 1, wherein the closure bracket and the clamping bracket are mechanically connected with one or more screws passing through one or more openings provided in at least one of the lateral flanges of the closure bracket and engaging one or more internal longitudinal slots provided in the clamping bracket.

6. The element of claim 1, further comprising a member supporting the lighting appliance, the member being coupled to a lateral flange of the closure bracket.

7. The element of claim 6, wherein a plurality of openings are provided in the lateral flange of the closure bracket where the member is coupled, the plurality of openings being configured for passage of electric cables connecting the one or more electrical components, housed within a space delimited by the clamping and closure brackets, to the first component and to the lighting appliance.

* * * * *